US008702450B2

(12) United States Patent
Nass

(10) Patent No.: US 8,702,450 B2
(45) Date of Patent: Apr. 22, 2014

(54) CONNECTING COMPONENT FOR ELECTRICAL CONDUCTORS AND METHOD FOR SHEATHING SUCH A CONNECTING COMPONENT

(75) Inventor: Andreas Nass, Warmsen (DE)

(73) Assignee: Harting Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 13/391,479

(22) PCT Filed: Aug. 12, 2010

(86) PCT No.: PCT/DE2010/000960

§ 371 (c)(1), (2), (4) Date: Feb. 21, 2012

(87) PCT Pub. No.: WO2011/020465

PCT Pub. Date: Feb. 24, 2011

(65) Prior Publication Data

US 2012/0149241 A1 Jun. 14, 2012

(30) Foreign Application Priority Data

Aug. 19, 2009 (DE) ..... 10 2009 038 062

(51) Int. Cl.
*H01R 13/58* (2006.01)

(52) U.S. Cl.
USPC ..... 439/606; 439/936

(58) Field of Classification Search
USPC ..... 439/606, 936, 736; 29/858, 883
See application file for complete search history.

(56) References Cited

U.S. PATENT DOCUMENTS

| | | | | |
|---|---|---|---|---|
| 5,319,156 | A * | 6/1994 | Fonteneau et al. | 439/607.17 |
| 6,428,357 | B1 | 8/2002 | Dollinshek | |
| 7,195,505 | B1 * | 3/2007 | Becker | 439/282 |
| 2009/0296355 | A1 | 12/2009 | Kraus | |

FOREIGN PATENT DOCUMENTS

| | | |
|---|---|---|
| DE | 32 48 715 | 7/1984 |
| DE | 10 2006 056258 | 5/2008 |
| GB | 2 061 635 | 5/1981 |

* cited by examiner

*Primary Examiner* — Ross Gushi
(74) *Attorney, Agent, or Firm* — Jacobson Holman PLLC

(57) ABSTRACT

A connecting component formed by a first housing, within which there are disposed electrical components which are connected to coupling elements acting outwards, is over-sheathed with an insulating envelope. The first housing is surrounded by a second housing, the coupling elements are guided through corresponding openings of the second housing, and the space between the two housings is overcasted with a polyurethane plastic compound. After curing, the thus formed sheath of the housing has, with only one process step, a shape identically reproducing that of the second outer housing.

9 Claims, 6 Drawing Sheets

CONNECTING COMPONENT FOR ELECTRICAL CONDUCTORS AND METHOD FOR SHEATHING SUCH A CONNECTING COMPONENT

CROSS-REFERENCE TO RELATED APPLICATIONS

This is a national stage of PCT/DE10/000960 filed Aug. 12, 2010 and published in German, which claims the priority of German number 10 2009 038 062.0 filed Aug. 19, 2009, hereby incorporated by reference.

BACKGROUND OF THE INVENTION

1. Field of the Invention

The invention concerns a connecting component with at least one coupling element acting outwards in which contact elements are disposed, which can be connected to one another within a first housing forming the connecting component, for contacting at least one plug-in connector formed with complementary coupling elements and contacts, wherein the first housing consisting of at least two shell elements forms a cavity in which electrical components are disposed.

A connecting component of this type is needed in order to enable a coupling of at least two electrical cables or lines with their plug-in connectors. Also, such a connecting component is necessary in order to introduce one or more branches in a connection point of two cables or lines. In connection with this the complete electrical and mechanical functionality of the couplings located in the connecting component must be ensured. In addition, the connections should be protected against environmental influences such as, for example, moisture and dirt.

2. Description of the Prior Art

It is a procedure known from practice to pot or overmold the entire assembly with attachments, connections, and internal parts with a curing potting compound to form a block.

U.S. Pat. No. 6,428,357 describes an electrical plug-in connector with a base housing which in a first process step is overmolded with a thermoplastic, elastic material.

Only with a second process step is there completion of a final overmolding conforming precisely to shape and including a strain relief extension for an attached cable.

From DE 10 2006 056 258 A1 an assembly of electrical and electronic components is known which is potted with a curing, electrically insulating potting material in a housing and is distinguished in that there is provided on the housing at least one attachment which is accessible from outside the housing and extends at least slightly into the housing, said attachment being electrically connected to the assembly and vacuum-potted together with the assembly from inside.

From DE 32 48 715 A1 an electrical switching unit is known with a housing in which there is disposed at least one holding body carrying a connecting means and electrical circuit elements, where plug-in connectors connected to corresponding connecting means project out, sealed, from said holding body and the housing part accommodating the holding body with all the circuit elements and plug-in connectors is filled at least partially with a casting compound.

The overmolding of plug-in connectors is entirely state of the art. In that process, contacting elements with electrical conductors or electrical cables are inserted into a corresponding mold and overmolded with an electrically non-conductive, insulating plastic. For this molding process plastics are required which, depending on the plastic, are injected at approximately 180-400° C. at a pressure of 15-400 bar into a corresponding mold with the elements held therein.

It is disadvantageous in these processes that during potting and filling or overmolding of entire assemblies a large volume of potting material must be used. This can lead to deaeration problems in the low-pressure injection process if a sufficient deaeration of the tool is not possible due to a complex contour of the component.

The large air volume which is displaced by the injected potting compound, under certain circumstances, cannot escape and unavoidable air bubbles arise which can lead to functional and/or visual limitations.

Likewise, a deformation of such large material volumes due to vibration processes during the cooling process is not to be ruled out.

A further disadvantage in a massive potting of such assemblies can be that the functionality of individual mechanical components is restricted or lost altogether due to penetration of the potting compound.

SUMMARY OF THE INVENTION

The object of the invention is to describe a connecting component in which in a housing equipped with coupling elements there are disposed electrical and/or electronic components and their connections which are to be protected against environmental influences in that it is possible to apply a plastic oversheath in a single process step to form a final, ready-for-use shape.

This object is achieved in that the two shell elements are connected at their plane of connection by means of a labyrinth seal and that the labyrinth seal is formed at least in part as an opening so that during an oversheathing of the first housing with a potting compound, portions of the potting compound can intentionally penetrate through the opening provided into the cavity of the shell elements.

Advantageous developments of the invention include that the sheath of the housing consists of a polyurethane plastic, that the shell elements of the first housing are interlocked or screwed into one another, and that the first housing includes an attachment for an electrical cable.

The object is furthermore achieved according to the process in that in a first inner housing formed from two shells there are inserted electrical components and contact elements which are connected to coupling elements acting outwards from the connecting component and which are for contacting one or more correspondingly formed plug-in connectors, that the first inner housing is inserted into a second housing surrounding it, where the first inner housing is held at a distance from the second housing and where the coupling elements project freely out of the second housing, that the first housing is overcasted in a single process step and with a potting compound filling up the space between the first and second housing, where small amounts of the filling potting compound in openings in a labyrinth seal connecting the two shells can get into the cavity of the inner housing, that after the filling up and curing the second surrounding housing is removed, where the first housing forms a unit with the surrounding sheath of the housing, said sheath consisting of the filling potting compound, where the smallest details introduced into the surface of the second housing are reproduced on the surrounding sheath of the housing and after the curing a final shape of the connecting component is presented, said shape requiring no further processing.

An advantageous development for the inventive process is that during the casting process small portions of the potting compound can intentionally penetrate into the opening of the first housing provided for this purpose, where the openings are formed by a spacing of the labyrinth seal between the halves of the housing at their plane of connection so that there is a sufficient deaeration of the injected potting compound through a slot between the collar and the coupling element of the housing so that air bubbles in the surrounding sheath of the housing can be avoided. In addition, during the casting process a RIM procedure is employed, where a polyurethane mixture is used as the potting compound which for processing has a temperature range of 60° C.- 90° C., with a preferred temperature of 80° C. and with an excess pressure of 1-5 bar, preferably 3 bar, and processing is done in a single potting process step.

The invention is a connecting component which is needed in order to connect two or more electrical conductors or cables to one another. The connecting component comprises at least two coupling elements with contact elements held therein, a device for contacting the contact elements among themselves, and a housing which accommodates the coupling elements.

The electrical conductors to be attached have at their connecting ends a plug-in connector housing with contact elements held therein which are complementary to the contact elements in the connecting component. The contacting of the contact elements occurs through a connection of the respective complementary plug-in connector to the coupling elements in the connecting component.

The housing which forms the body of the connection components consists of several parts, preferably of two individual parts. The first housing represents a base body and is enveloped by an outer sheath of the housing, where the outer sheath of the housing represents the final shape of the connecting component.

The housing is preferably composed of two prefabricated parts of the housing. In recesses of the prefabricated parts of the housing the coupling elements for attachment of the conductor to be attached are inserted. The contact elements located in the coupling elements are connected and electrically contacted to one another in the cavity which the two prefabricated parts of the housing form.

In a preferred form of embodiment the prefabricated parts of the housing are provided with locking means which prevent them from falling out of one another again after the joining together of the individual parts of the housing.

The outer sheath of the housing, said sheath forming a protection against environmental influences for the connecting component, is applied directly to the first housing after the joining together of the inner parts of the housing.

For this, the entire structure of the first inner housing is expediently overcasted from outside with the low-viscosity plastic sheath of the housing. Merely the coupling elements projecting out from the first housing are spared in order to ensure their contacting.

The sheath of the housing preferably consists of a low-viscosity, reactive plastic which is cast over the first inner housing, that is, the cavity between the outer and inner housing.

Here polyurethane has proven itself particularly suitable since due to its low viscosity and good flowability it is possible to achieve low wall thicknesses as well as differences in wall thickness and good moldability of special features of the housing, such as, for example, a logo.

An additional advantage of polyurethane is its rapid reaction time, which is needed in order to be able to carry out the process economically.

Still further, the reaction time can be shortened significantly if the so-called RIM process (reaction injection molding) is used since with this process the setting time is only a few seconds.

Unlike the process described above, in the procedure presented here for advantageously overcasting a housing with polyurethane merely a temperature range of 60° C.-90° C., preferably 80° C., and an excess pressure of 1-5 bar, preferably 3 bar, is needed.

This temperature and pressure range has proven itself particularly advantageous, above all in regard to electronic components to be encased.

In an expedient form of design the prefabricated parts of the housing have a labyrinth structure at their plane of connection. This normally prevents the penetration of potting compound during the potting of the first housing with the external sheath of the housing.

In connection with this the labyrinth structure can include an advantageous design with openings which cause a controlled penetration of the potting compound into the interior of the housing so that during the casting process air bubbles within the sheath of the housing are prevented.

Along with electrical connections, the contact structures to be connected can also be optical waveguides or even pneumatic or other connections which are to be provided to transmitting any signals.

Thus the contact and coupling elements used in the connecting component are to be chosen according to the type of medium to be transmitted.

Furthermore, adding a direct cable attachment to the connecting component can also be provided.

BRIEF DESCRIPTION OF THE DRAWINGS

An embodiment example of the invention is represented in the drawings and is explained in more detail in the following.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the are from this detailed description.

Figure 1:
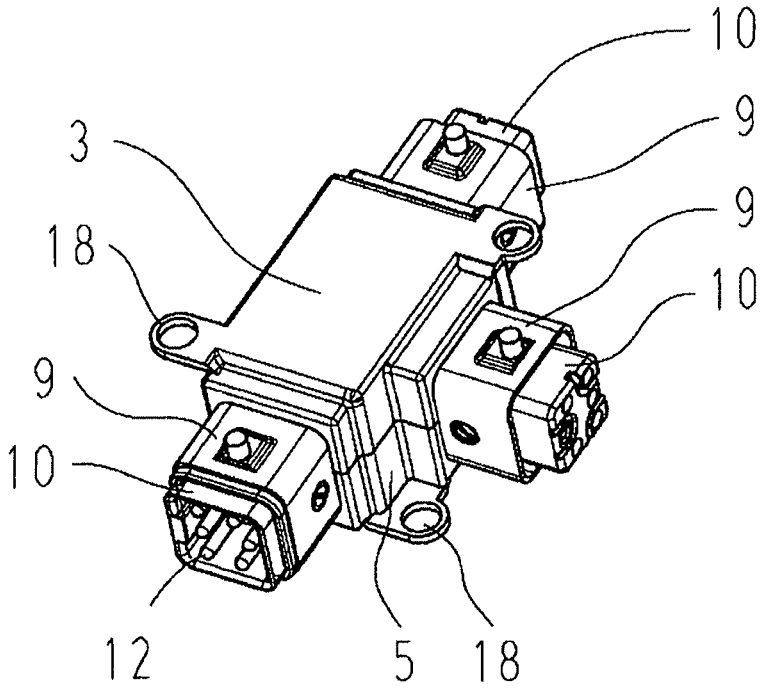
FIG. 1 a perspective view of a mounted first housing with coupling elements, FIG. 2 a perspective view of an opened first housing formed from two half-shells, FIG. 3 a detail view of a labyrinth connection, FIG. 4 a detail view of a coupling element and the first housing, FIG. 5 a first and second housing, partially sectioned with potting compound laid in, FIG. 6 a connecting component overcasted with a sheath of the housing, FIG. 7*a* a connecting component with an attached electrical cable in a sectional view, and FIG. 7*b* the connecting component from FIG. 7*a* in a perspective view.

In FIG. 1 a connecting component for contacting electrical conductors provided with contact elements is represented.

The connecting component shows a first housing 1, which here is formed from two shell elements 3, 5 and in whose interior there is only one connection of the three coupling elements 10 shown here or also an electric/electronic circuit with a connection to the coupling elements 10 which act outwards and in which in turn contact elements 12 are disposed. Furthermore, fastening openings 18 can also be seen here at several corner areas of the housing.

Figure 2:
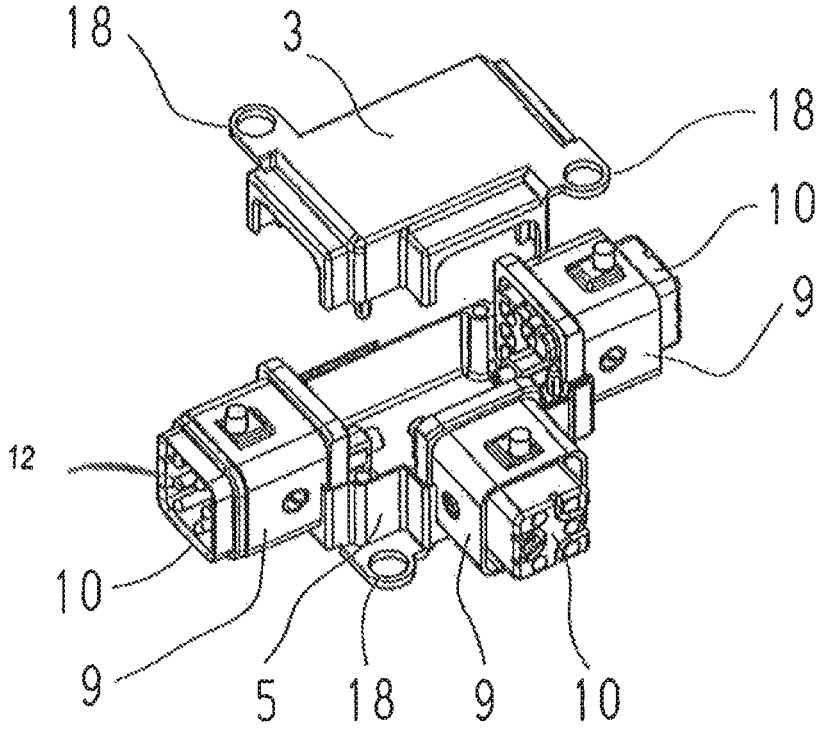

FIG. 2 shows the connecting component, wherein the two shell elements 3, 5 of the first housing 1 are opened so that it is possible to view the coupling elements 10 inserted here at the three sides of the housing and optionally internal connections not shown here.

From this is can be concluded first of all that also in connection with the inserted coupling elements 10 the first housing 1 has no absolute sealing from the external environment.

The object of the first housing 1 is to hold an approximate shape onto which a final sheath 20 of the housing is cast.

Figure 3:
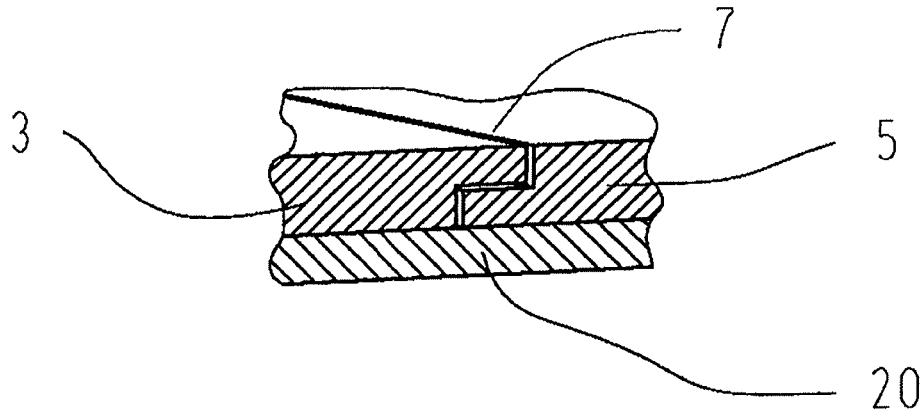

A detailed representation of the connecting area of the two shell elements of the housing is shown in FIG. 3.

Therein the two shell elements 3, 5 are connected to one another at their contact edges by means of a so-called labyrinth seal 7 so that on the one hand a certain stability and on the other hand a simple penetration of the compound to be used for overcasting is initially prevented.

However, this labyrinth seal can also be conceived so as to allow potting compound to intentionally get into the interior of the housing.

Figure 4:
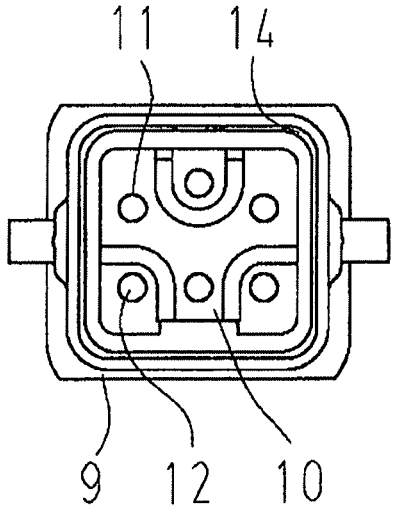

Nearly unavoidable however are openings between the housing 1 and the coupling elements 10, as is shown in a detail view of FIG. 4. Such a gap 14 between the collar 9 and the contact element 12 can be introduced intentionally for a deaeration of the potting compound (i.e., final sheath) 20 in order to avoid air bubbles in the area of the sheath of the housing during potting.

Figure 5:
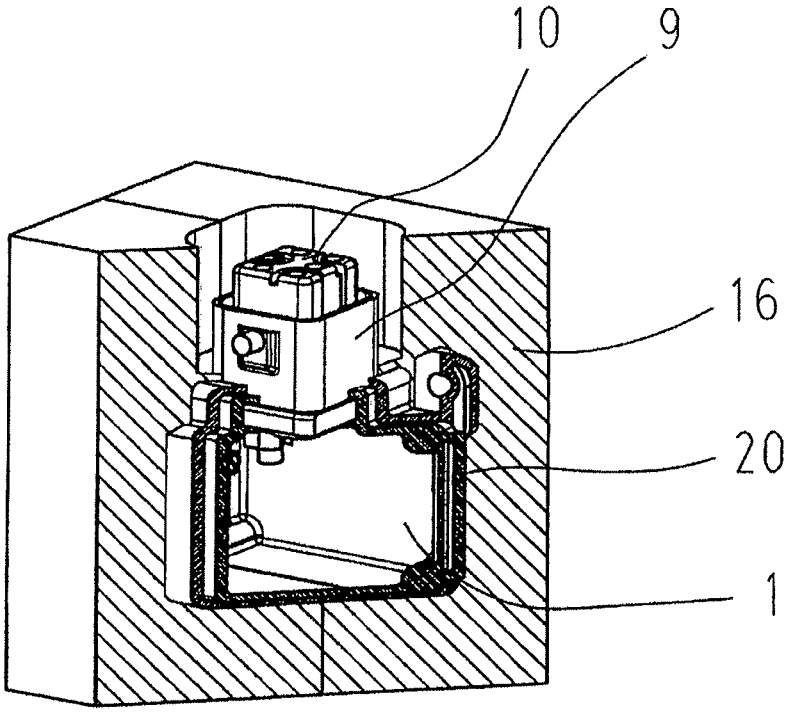

In FIG. 5 a first housing 1 and a second housing 16 are represented in tiered sections so that the inner first housing 1 can be seen, the overcasted final sheath 20 of the housing and the outer second housing 16 necessary for overcasting. The outer housing 16 is formed as a tool with corresponding connections to the compound to be overcasted, said connections not being shown here.

Figure 6:
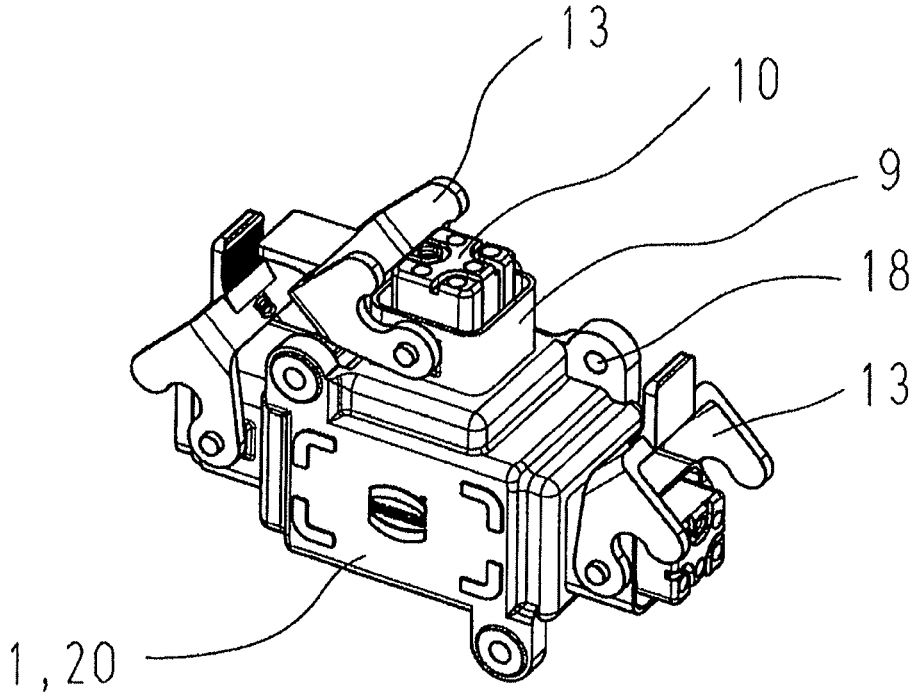

Already overcasted with the potting compound (i.e., final sheath) 20, a connecting component which needs no further processing is shown in FIG. 6, wherein the housing 1 comprises coupling elements 10 with locking brackets 13 as well as holding eyes 18 which are also oversheathed.

In a further development it can be provided that during the overcasting of the first housing 1 the connecting component is formed directly with a cable connection 24, i.e. to provide a ready-made plug-in cable attachment in single process step.

Figure 7A:
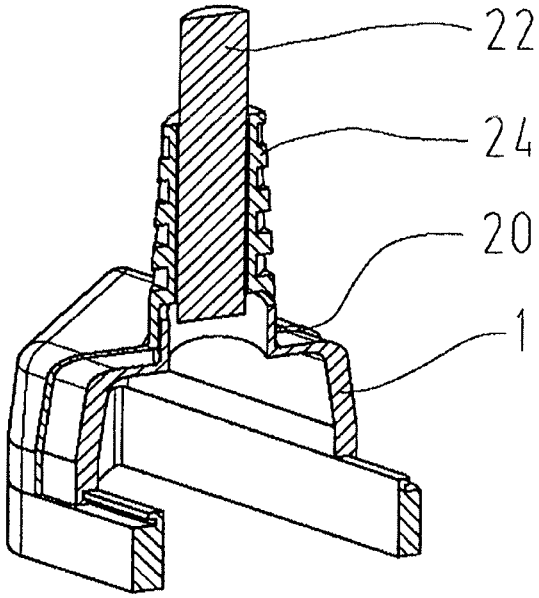
Figure 7B:
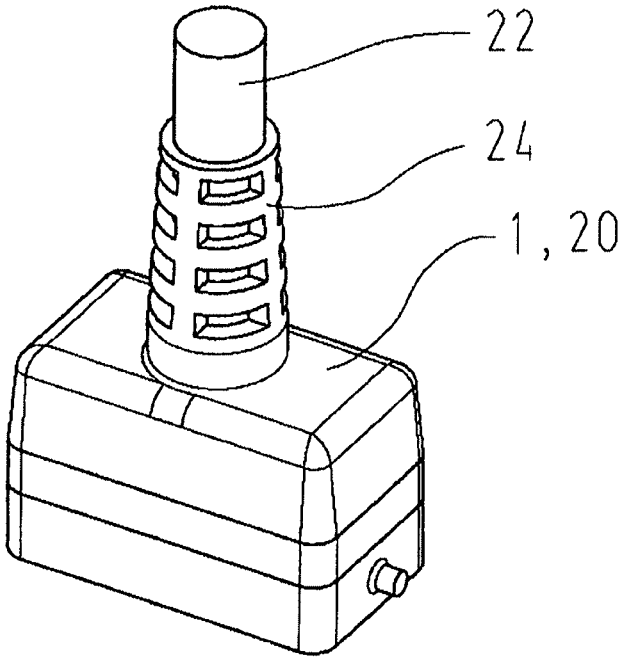

For this, an example of this type is shown in FIGS. 7*a* and 7*b*. Therein, in addition to the first housing 1 formed as a plug-in connector, a part of the attached cable 22 is surrounded with an anti-kink type of cable connection 24, both fabricated together in one potting process step.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

REFERENCE NUMBER LIST

1 first housing
2
3 shell element 1 (parts of the housing)
4
5 shell element 2
6
7 labyrinth seal (for intentionally letting in potting compound)
8
9 collar for a coupling element
10 coupling element (plug-in connector, bushing)
11 contact finger
12 contact elements
13 locking bracket
14 gap between the collar and coupling element (deaeration)
15
16 second housing (casting housing tool)
17
18 holding eyes
19
20 sheath of the housing (casting compound)
21
22 electrical cable
23
24 attachment (cable holder)

What is claimed is:

1. A connecting component comprising at least one coupling element acting outwards in which contact elements are disposed which are connectable to one another within a first housing forming the connecting component and which are for contacting at least one plug-in connector formed with complementary coupling elements and contacts, the first housing of at least two shell elements forming a cavity in which electrical components are disposed, the two shell elements being connected to one another at a plane of connection via a labyrinth seal, the labyrinth seal (i) providing least a first plane of connection, and a second plane of connection different from the first plane of connection, and (ii) being configured at least in part to include an opening so that during an oversheathing of the first housing with a potting compound, portions of the potting compound can intentionally penetrate through the opening provided into the cavity of the shell elements.

2. The connecting component according to claim 1, wherein the sheath of the housing has a material of construction that is a polyurethane plastic.

3. The connecting component according to claim. 1, wherein the shell elements of the first housing are interlocked or threaded into one another.

4. The connecting component according to claim 1, further comprising on the first housing an attachment for an electrical cable.

5. A method of producing a connecting component, comprising in an inner first housing formed from two shells, inserting electrical components and contact elements which are connected to coupling elements acting outwards from the connecting component and which are for contacting one or more correspondingly formed plug-in connectors, inserting the inner first housing into a second housing surrounding the first housing, the first housing being held at a distance from the second housing and the coupling elements projecting freely out of the second housing, overcasting the first housing in a single process step and with a potting compound filling up a space between the first housing and the second housing, such that small amounts of the filling potting compound in openings in a labyrinth seal connecting the two shells are able to penetrate into a cavity of the inner housing, the labyrinth seal providing at least a first plane of connection, and second plane of connection different from the first plane of connection, and after the filling up of the space and curing of the potting compound, removing the surrounding second housing the first housing forming a unit with a sheath surrounding the first housing, said sheath including the filling potting compound, with details introduced into a surface of the second housing being reproduced on the sheath surrounding the housing, such that after the curing a final shape of the connecting component is presented, said shape requiring no further processing.

6. The method of producing a connecting component according to claim 5, wherein during the casting process the small amounts of the potting compound intentionally penetrate into the openings of the first housing provided therefor, the openings being formed by a spacing of the labyrinth seal between the shells of the first housing at a plane of connection so that there is a sufficient deaeration of the injected potting compound through a slot between a collar and the coupling element of the housing so that air bubbles in the surrounding sheath of the housing can be avoided.

7. The method of producing a connecting component. according to claim 5, wherein during the casting process a reaction injection molding procedure is employed, with a polyurethane mixture being used as the potting compound, which for processing has a temperature range of 60° C. -90° C., and with an excess pressure of 1-5 bar, said processing being done in a single potting process step.

8. The method according to claim 7, wherein the temperature is 80° C.

9. The method according to claim 7, wherein the excess pressure is 3 bar.

* * * * *